US007118333B2

(12) United States Patent
Takemoto

(10) Patent No.: US 7,118,333 B2
(45) Date of Patent: Oct. 10, 2006

(54) ELECTRIC COOLING FAN AND CASE OF ELECTRONIC OR ELECTRIC DEVICE

(75) Inventor: Shinji Takemoto, Kyoto (JP)

(73) Assignee: Nidec Corporation, Kyoto (JP)

( * ) Notice: Subject to any disclaimer, the term of this patent is extended or adjusted under 35 U.S.C. 154(b) by 64 days.

(21) Appl. No.: 10/707,104

(22) Filed: Nov. 20, 2003

(65) Prior Publication Data

US 2004/0101404 A1 May 27, 2004

(30) Foreign Application Priority Data

Nov. 22, 2002 (JP) ..... 2002-338693

(51) Int. Cl.
*F01D 1/02* (2006.01)
*F04D 29/70* (2006.01)

(52) U.S. Cl. ..... 415/211.2; 415/121.2; 415/220

(58) Field of Classification Search ..... 415/121.2, 415/211.2, 208.2, 220, 221, 191; 416/247 R; 417/423.9

See application file for complete search history.

(56) References Cited

U.S. PATENT DOCUMENTS 1,313,460 A * 8/1919 Branson ..... 416/247 R
2,100,994 A * 11/1937 Cohen ..... 415/121.2
3,481,534 A * 12/1969 Price ..... 415/146
4,482,302 A * 11/1984 Grignon ..... 415/220
4,603,271 A * 7/1986 Maruyama et al. ..... 416/169 A
5,788,566 A * 8/1998 McAnally et al. ..... 415/213.1
6,024,536 A 2/2000 Tsubakida et al.
6,244,818 B1 6/2001 Chang
6,503,060 B1 * 1/2003 Kamada et al. ..... 416/247 R
6,764,277 B1 * 7/2004 Somahara et al. ..... 415/121.2

FOREIGN PATENT DOCUMENTS

JP 5-274062 A 10/1993
JP 10-66305 A 3/1998
JP 11-354964 A 12/1999
JP 2000-257597 A 9/2000

* cited by examiner

*Primary Examiner*—Igor Kershteyn
(74) *Attorney, Agent, or Firm*—Judge & Murakami IP

(57) ABSTRACT

A case that is used for an electronic or electric device has an opening portion arranged at a vicinity of a fan motor that generates airflow inside and outside the case. The opening portion has a protection portion for preventing a finger or other matters from entering the fan motor. The protection portion includes a first rib group extending linearly in a lateral direction, a second rib group extending linearly in a second direction vertical direction. Each of the ribs has an inclined surface that is along a direction of the airflow exhausted from the fan motor and faces the inside or the outside of the opening portion.

13 Claims, 14 Drawing Sheets

92 92a～92d
93 93a～93f
94 94a～94f
95 95a～95l

ELECTRIC COOLING FAN AND CASE OF ELECTRONIC OR ELECTRIC DEVICE

BACKGROUND OF INVENTION

1. Field of the Invention

The present invention relates to an electronic or electric device such as a personal computer, a computer game machine or a printer, which has a cooling fan housed in a case. The present invention also relates such a cooling fan and a case used for the electric device.

2. Description of the Prior Art

An electronic or an electric device such as a personal computer, a computer game machine or a printer includes various electromechanical parts housed in a case. Since the inside of the case becomes high temperature due to heat generated by a CPU and/or IC chips, or electromechanical parts, a cooling fan is disposed in the case. This fan is usually arranged at a vicinity of an opening (an exhaust hole) formed in the side-wall of the case. The inside air of the case is exhausted through this opening externally, so that the inside of the case is cooled.

This opening is usually provided with a mesh guard that is called a finger guard for preventing a finger or other matters from entering and stopping the fan or from being injured. There are two types of this finger guard as shown in FIGS. 13A and 13B. The first type of the finger guard as shown in FIG. 13A has a shape that is a combination of circular ribs and radial ribs. This type of the finger guard is disclosed in Japanese unexamined patent publication No. 2000-257597 for example. The second type of the finger guard as shown in FIG. 13B has a grid shape formed by plural ribs. This type of the finger guard is disclosed in Japanese unexamined patent publication No. 5-274062 or No. 11-354964.

However, the mesh finger guard attached to the opening as an exhaust hole for the cooling fan may disturb smooth exhausting of air inside the case since the exhaust air may be interrupted by the finger guard. There is another problem that large noise may be generated when the exhaust air is interrupted by the finger guard.

As a measure of this problem, there is a well-known finger guard, in which each of the ribs constituting the cross-section shape of each rib has a round corner portion so that the air resistance caused by the ribs is reduced. However, this measure is not still a sufficient for achieving substantial improvement against the above-mentioned problem.

In these years, higher cooling performance and quieter property are required for an electronic or electric device that has been becoming more powerful and more compact. However, available finger guards up to now cannot satisfy such demands sufficiently.

SUMMARY OF THE INVENTION

An object of the present invention is to provide a case for an electronic or electric device having a fan motor that can an intake or exhaust air efficiently at a low noise level through an air intake or exhaust opening with a finger guard. Another object of the present invention is to provide a fan motor with a finger guard on the fan motor frame that can intake or exhaust air efficiently at low noise level.

The present invention is characterized in a shape of a cross section of each rib constituting a finger guard that is provided in an airflow path of a cooling fan. According to one aspect of the present invention, the finger guard includes plural first ribs extending in the lateral direction and plural second ribs extending in the vertical direction. The cross section shape of each of the first and second ribs has an inclined surface that is substantially parallel to or along the direction of the airflow that is drawn in or exhausted from a fan motor as being rotated spirally. Another finger guard according to the present invention has ribs formed like a grid or a mesh, and the cross section shape of each of the ribs has at least one inclined surface that is substantially parallel to or along the direction of the airflow that is drawn in or exhausted from the fan motor as being rotated spirally. In this way, the intake or exhaust airflow is not disturbed so that generation of air turbulence can be prevented. As a result, cooling efficiency can be improved and generation of noise can be suppressed.

The present invention is applied to a case of an electronic device having the finger guard that is provided to an opening portion at a vicinity of the fan motor. Furthermore, the present invention can be realized by providing the finger guard in an outer frame portion of the fan motor itself. In this case, the finger guard can be formed integrally with the case of the electronic device or the outer frame of the fan motor. Alternatively, the finger guard can be provided with a supporting member to be attached to the case, or can be attached via a special attachment member for a fan.

DETAILED DESCRIPTION

DESCRIPTION OF THE PREFERRED EMBODIMENTS

Hereinafter, the present invention will be explained more in detail with reference to embodiments and drawings.

(First Embodiment)

Figure 1:
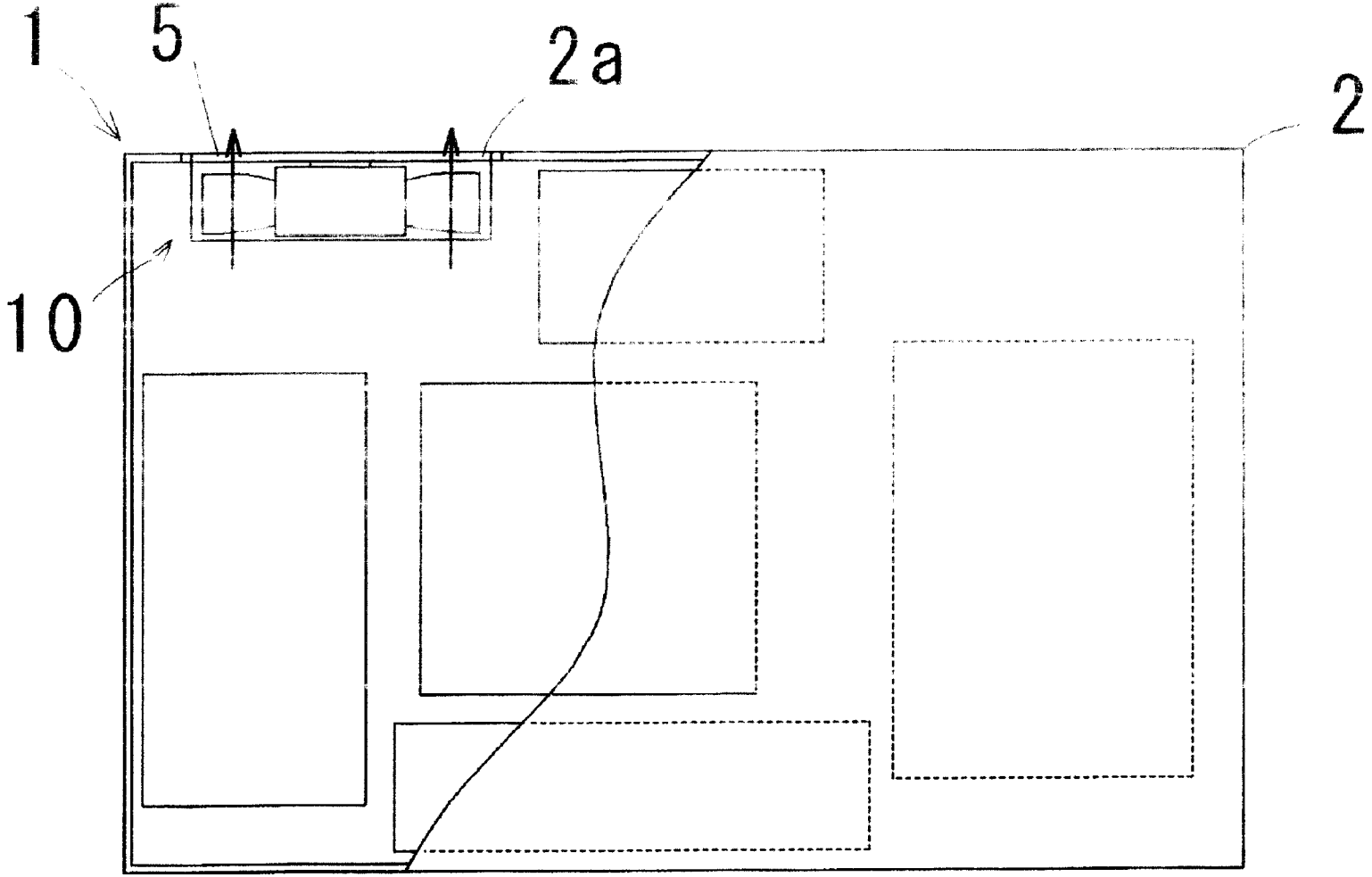
FIG. 1 is a plan view showing an electronic or electric device according to a first embodiment of the present invention.
Figure 2:
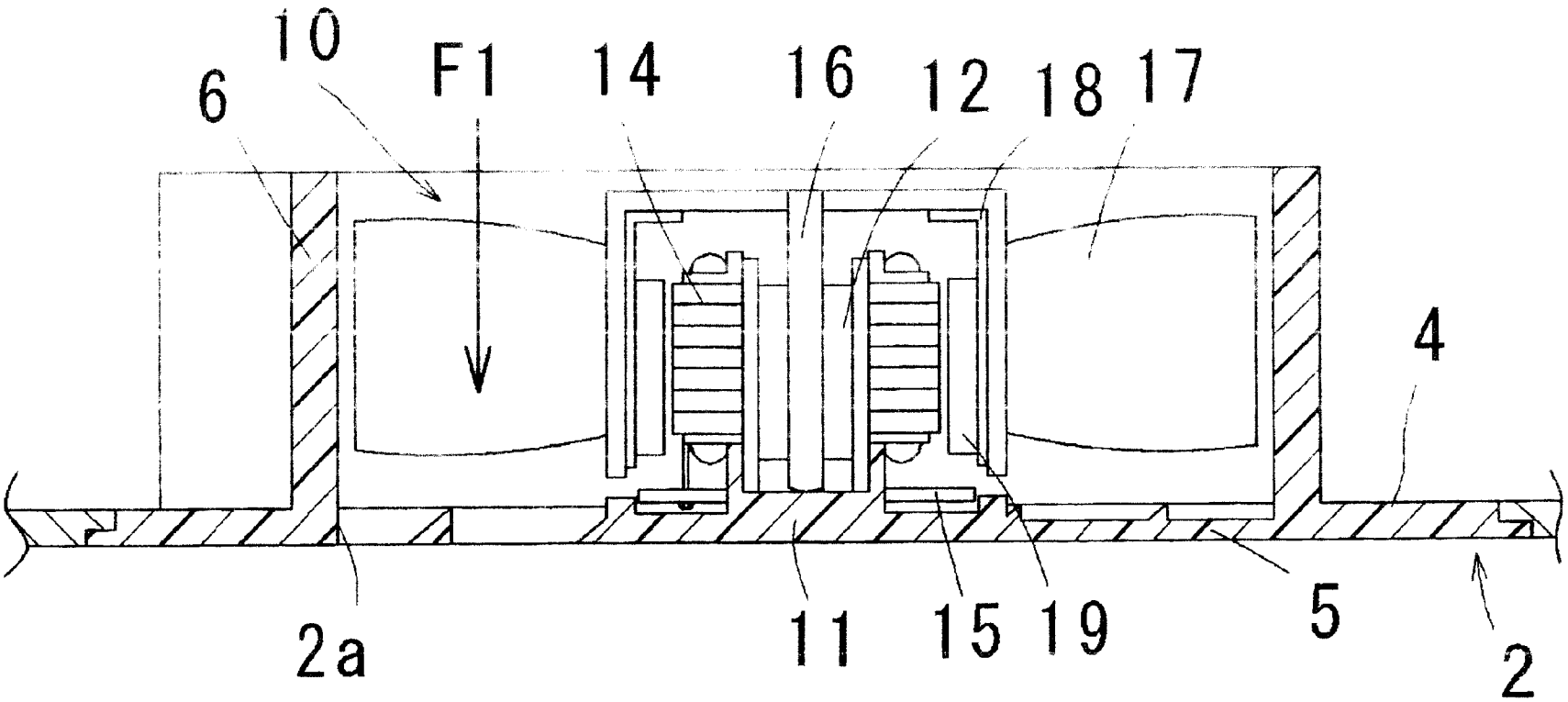
FIG. 2 is a cross section of a main portion in FIG. 1.
Figure 3:
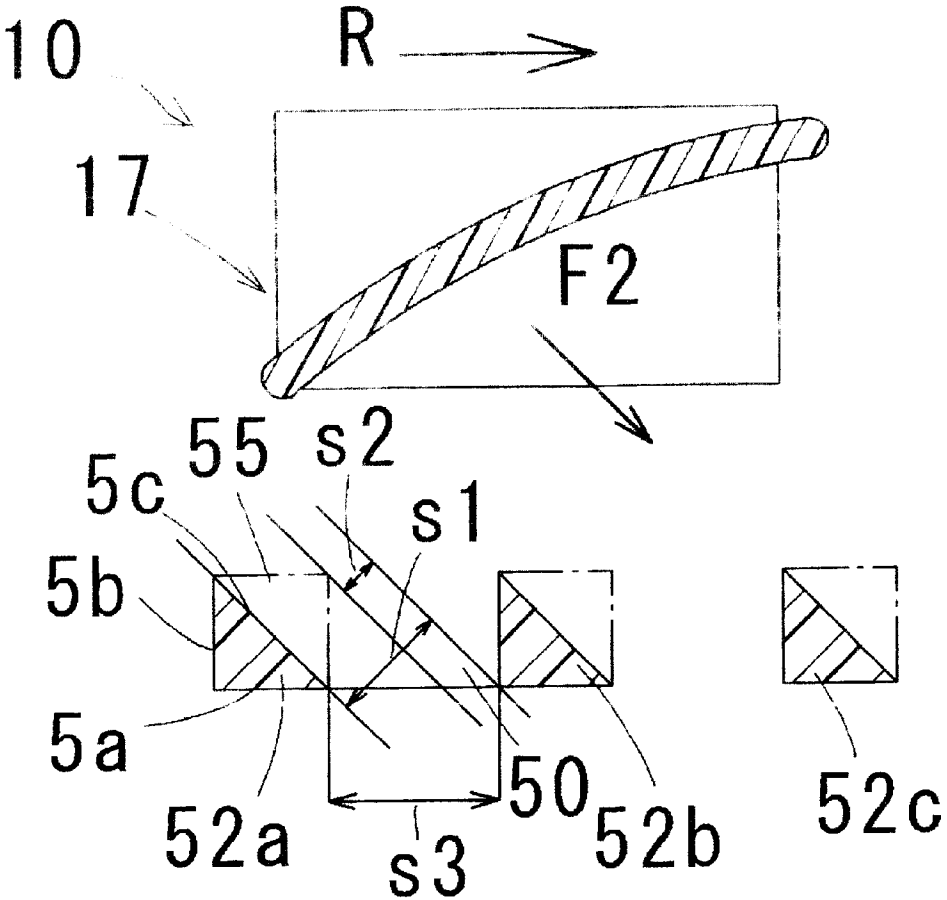
FIG. 3 is a cross section of a main portion in FIG. 2.
Figure 4:
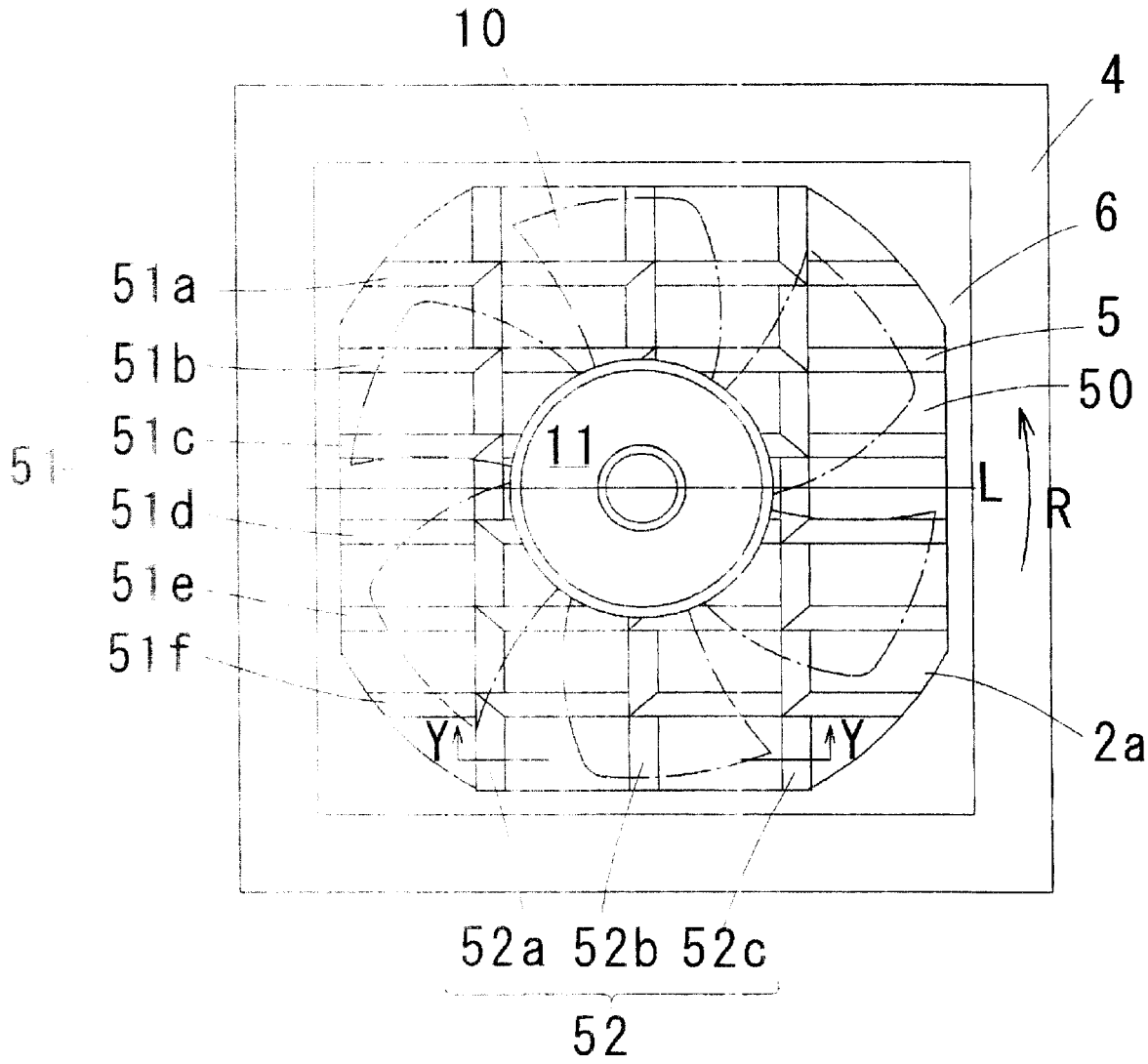
FIG. 4 is a plan view of a main portion in FIG. 2.

A first embodiment of the present invention will be explained with reference to FIGS. 1–4. FIG. 1 is a plan view that shows an inner structure of the electronic or electric device schematically. FIG. 2 is a cross section of a main portion of a fan motor that is included in the device. FIG. 3 is a cross section of a main portion cut along the Y—Y line in FIG. 4. FIG. 4 is a plan view of a main portion in which an opening portion of the case of the electronic or electric device shown in FIG. 1 is viewed from the inside toward the outside.

[Electronic or Electric Device]

As shown in FIG. 1, an electronic or electric device 1 of the first embodiment is a main body of a desktop type personal computer, for example. A cooling fan motor 10 is provided in the case 2. The fan motor 10 is arranged at the inside and a vicinity of an opening portion 2*a* that is formed in the side wall of the case, so as to exhaust air inside the case 2 through the opening portion 2*a* for cooling the inside of the case 2. The opening portion 2*a* is provided with a finger guard 5 that is formed integrally with the opening portion 2*a* as shown in FIG. 2. A side wall that constitutes the opening portion 2*a* is formed as another member (hereinafter called as a sub panel 4) separated from the case 2. The sub panel 4 includes the finger guard 5 that is formed at the opening portion 2*a* as well as a cylindrical portion 4 that surrounds the fan motor 10.

[Structure of a Finger Guard]

The finger guard 5 includes a first rib group 51 and second rib group 52 as shown in FIG. 4. The first rib group 51 includes six ribs 51*a*–51*f* that connects between the left and the right sides of the opening portion 2*a* at each six points that are obtained by dividing each of the sides by seven equally as shown in FIG. 4. The second rib group 52 includes three ribs 52*a*–52*c* that connects between the upper and the lower sides of the opening portion 2*a* at each three points that are obtained by dividing each of the sides by four equally as shown in FIG. 4. Hereinafter, the direction in which the first rib group 51 extends is called the lateral direction, while the direction in which the second rib group 52 extends is called the vertical direction.

A thickness of the both rib groups 51 and 52 is substantially the same as the sub panel 4. A rib end portion of the rib groups 51 and 52 is connected to the rim of the opening portion 2*a* integrally. Middle portions of the rib groups 51 and 52 cross each other and are connected to each other integrally.

A rectangular opening 50 that is a small cell defined by the ribs 51*a*–51*f* and 52*a*–52*c* or these ribs and the rim of the opening portion 2*a* has a size such that a fingertip cannot enter. The opening defined by the ribs 51*b*, 51*e*, 52*a* and 52*c* is provided with a disk portion 11 that is formed integrally so as to close the opening. This disk portion is a motor supporting portion 11 that will be explained later.

The ribs 51*a*–51*f* and 52*a*–52*c* have the same width and extend straightly. A cross section thereof has a shape of a right triangle. The shape of the ribs 52*a*–52*c* as an example will be explained in detail with reference to FIG. 3. In this embodiment, each bottom surface 5*a* corresponding to the bottom side of the right triangle is aligned on the same plane with the outer surface of the case 2. On the other hand, each side surface 5*b* corresponding to the height of the right triangle is located in parallel with the rotation axis 16 of the fan motor 10 and is located at the upper stream side of the airflow generated by rotation to the fan motor 10. In addition, each inclined surface 5*c* corresponding to the hypotenuse of the right triangle has the direction that is substantially parallel to or along the direction of the airflow exhausted from an impeller 17 (an arrow F2). Since at least one surface of the rib cross section of the finger guard is made an inclined surface that is substantially parallel to or along the direction of the cooling airflow, turbulence of air is prevented so as to realize high efficiency of cooling performance and low noise level.

Next, other portions of the ribs 52*a*–52*c* and each of the ribs 51*a*–51*f* will be explained. In first rib group 51, when dividing each of the ribs 51*a*–51*f* of the opening portion 2*a* into two by the line (the rib 52*b*) that passes the center of the opening portion 2*a* and extends in the vertical direction, the inclined surface 5*c* of the first rib group 51 that is positioned at the left side of the rib 52*b* faces down in FIG. 4. Similarly, the inclined surface 5*c* of the first rib group 51 that is positioned at the right side of the rib 52*b* faces up in FIG. 4. Since the inclined surface of the rib is parallel to or substantially along the direction of the airflow that exhausted from the fan motor as rotating spirally, turbulence of air is prevented. In this way, a flow of cooling exhaust air becomes smooth, a loss due to collision of air against the rib can be minimized, and a noise level is lowered.

Similarly, in the second rib group 52, when dividing each of the ribs 52*a*–52*c* of the opening portion 2*a* into two by the line by the line L that passes the center of the opening portion 2*a* in the lateral direction, the inclined surface 5*c* of the second rib group 52 that is positioned at the upper side of the line faces left. In the same way, the inclined surface 5*c* of the second rib group 52 that is positioned at the lower side of the line L in FIG. 4 faces right. The rib side between 51*c* and 51*d* on the rib side 52*a* positioned on the line L, as well as the rib side between 51*c* and 51*d* of the rib side 52*c* has the inclined surface that is set parallel to or substantially along the direction of the airflow that is exhausted from the fan motor as rotating spirally.

[Structure of the Fan Motor of the Electric Fan]

The fan motor 10 includes a motor having an impeller 17 as shown in FIG. 2. The fan motor 10 includes the motor supporting portion 11 having a bearing portion 12, an armature 14 and a circuit board 15. The bearing portion 12 supports the rotation axis 16 that is connected to the impeller 17 in a rotatable manner. The impeller 17 includes a main body having a cup-like shape and plural blades that are attached to the outer surface of the cup-like shape. The inner surface of the main body is provided with a magnet 19 via a yoke 18. When the armature 14 is supplied with a current, a rotation force is generated in the magnet 19 due to electromagnetic action between the armature 14 and the magnet 19, so that the impeller 17 is rotated. In this way, the plural blades are rotated so as to generate the airflow in the direction of the arrow F1.

[Characteristics of the Electronic or Electric Device to Which the Present Invention is Applied]

Next, characteristics of the electronic or electric device 1 will be explained.

As a first characteristic, the finger guard 5 can prevent a finger or other matters (such as a coin) from entering from the outside of the opening portion 2*a* into the fan motor 10 that is attached to the inside of the opening portion 2*a*, so that a malfunction of the fan motor 10 can be avoided.

As a second characteristic, since the first and the second rib groups 51 and 52 are provided with the inclined surface 5*c* as explained above, the air that is exhausted from the fan motor 10 can pass the finger guard 5 smoothly. Therefore, the inside of the case 2 of the electronic or electric device 1 can be cooled efficiently by the fan motor 10.

The reason thereof will be explained more specifically with reference to FIG. 3. The air exhausted from the impeller 17 flows along the axis direction of the motor in a macroscopic manner. However, a direction of the airflow generated by one blade becomes inclined from the axis direction, in which a component in the rotation direction of the impeller 17 is added to a component in the axis direction. Namely, it is a direction like a spiral inclined from the axis direction (as shown by the arrow F2 in FIG. 3).

For example of the ribs 52*a*–52*c* as shown in FIG. 3, the direction of air generated by the blade (an arrow F2) is substantially parallel to the direction of the inclined surface 5*c*. Therefore, the air generated by the blade flows through the opening 50 along the inclined surface 5*c*. In this case, the exhaust airflow passes the gap surface s1 of the opening 50 that is perpendicular to the arrow F2.

On the contrary, in the conventional rib 55 that has a rectangular cross section defined by the imaginary line that is added to the ribs 52*a*–52*c* as shown in FIG. 3, air generated by the blade passes the inclined opening gap surface s2 that is shown by the reference s2. Since this gap surface s2 is narrow, a many portion of the exhaust airflow will collide the rib 55 so that turbulence of air may be generated.

These ribs 52*a*–52*c* and the conventional rib 55 without an inclined surface have the same size of the opening area as shown by the reference s3 when viewing the opening 50 from the front. However, the opening area becomes different between them as shown by references s1 and s2 when viewing slantingly from a specific direction as the arrow F2 (s1>s2). The air passing the opening 50 has smaller resistance, as the opening area is larger toward the flow direction. Therefore, the air can flow smoothly without colliding a rib through the opening 50 defined by the ribs 52*a*–52*c*. In addition, turbulence of air that is generated when air collides a rib decreases so that a noise level is lowered.

As a third characteristic of the first embodiment, the finger guard 5 has a high stiffness since the two rib groups 51 and 52 cross each other like a grid.

As a fourth characteristic of the first embodiment, since the finger guard 5 has a grid shape, size of each opening 50 can be adjusted easily. Namely, since the size of each opening 50 is changed by the distance between ribs, protecting effect by the finger guard 5 can be set easily.

As a fifth characteristic of the first embodiment, the sub panel 4 that constitutes the finger guard 5 has functions as a supporting member of the fan motor 10 and a member that constitutes the case 2. Common parts can be used both for the case 2 and the fan motor 10, and assembly thereof is simplified.

Figure 5:
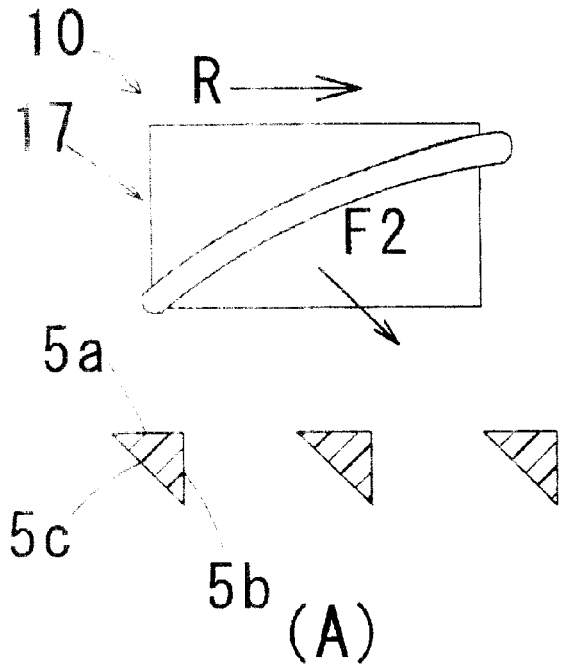
FIGS. 5A and 5B are cross sections of a main portion showing variations of the first embodiment.
Figure 5:
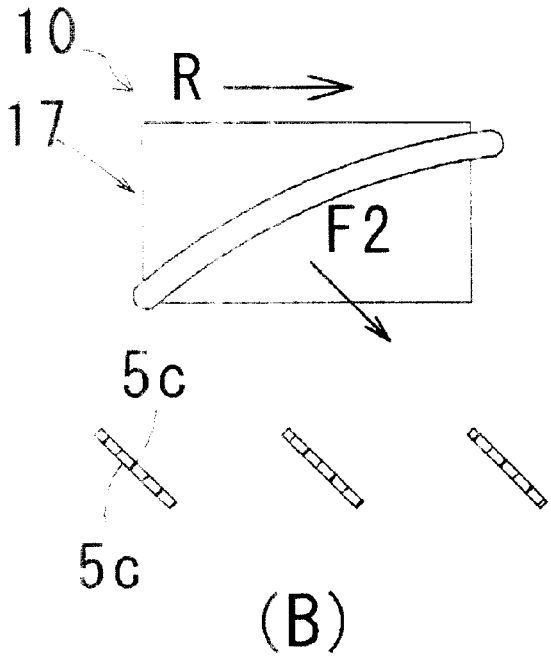

In a variation of this embodiment of the finger guard 5, the inclined surface 5*c* of the rib faces the outer side of the opening portion 2*a* as shown in FIG. 5A. The side surface 5*b* is positioned at the downstream side of the airflow generated by rotation of the fan motor 10. In another variation as shown in FIG. 5B, the cross section of the rib is a rectangle, and the long side of the rectangle is inclined in the direction that is parallel to or along the airflow exhausted from the fan motor as rotating spirally.

The above explanation is about the case where the fan motor generates the exhaust airflow from the inside to the outside of the case. However, if the fan motor generates the intake airflow that is air from the outside to the inside of the case, the inclined surface of the rib may be changed. Also in this case, it is inclined similarly in the direction that is parallel to or substantially along the airflow exhausted from the fan motor as rotating spirally.

(Second Embodiment)

Figure 6:
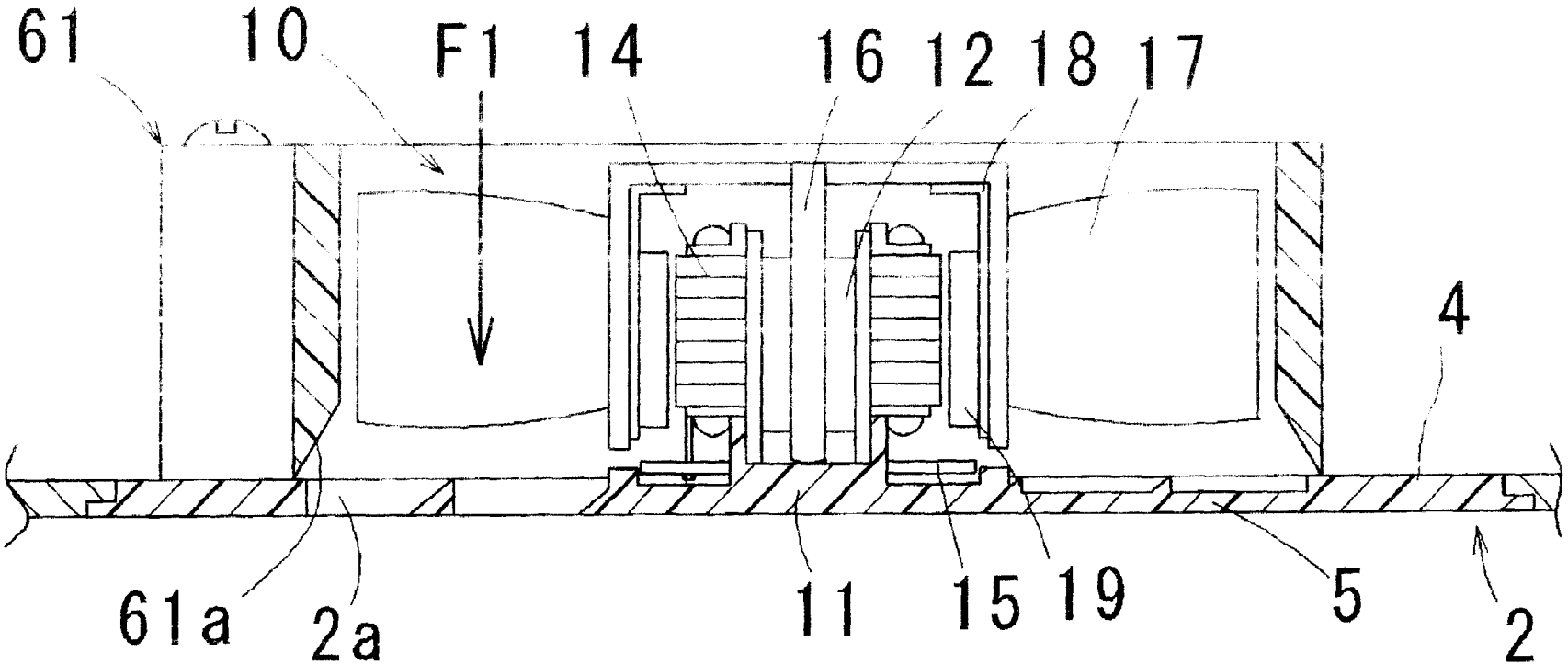
FIG. 6 is a cross section of a main portion showing an electronic or electric device according to a second embodiment of the present invention.

In the first embodiment, the cylindrical portion 6 surrounding the fan motor 10 is formed integrally with the sub panel 4. The second embodiment, however, is different from the first embodiment in that the cylindrical portion 6 is made as another member (hereinafter, referred to as a cylindrical member 61) separated from the sub panel 4 as shown in FIG. 6. As shown in FIG. 6, the cylindrical member 61 is similar to the cylindrical portion 6, but includes an inclined surface 41*a* in which the inner end portion of the opening portion 2*a* side enlarges the diameter to the opening portion 2*a* side. The cylindrical member 61 is fastened to the sub panel 4 by a screw. By providing this inclined surface 41*a*, air flows smoothly from the fan motor 10 to the opening portion 2*a*, so that airflow characteristics is improved.

This inclined surface 41*a* can be formed more easily than the first embodiment by structuring it as the cylindrical member 61 separated from the sub panel 4 like this embodiment.

(Third Embodiment)

Figure 7:
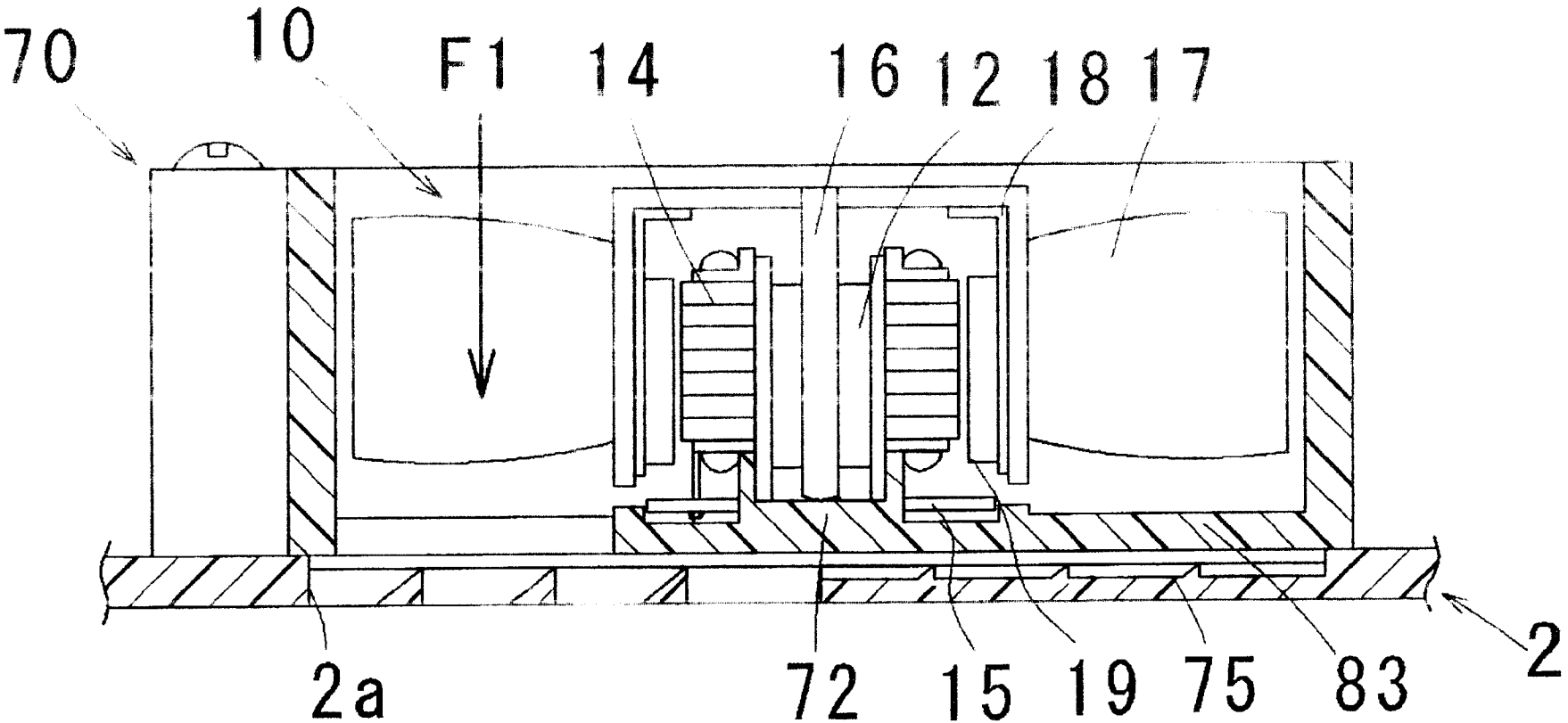
FIG. 7 is a cross section of a main portion showing an electronic or electric device according to a third embodiment of the present invention.
Figure 8:
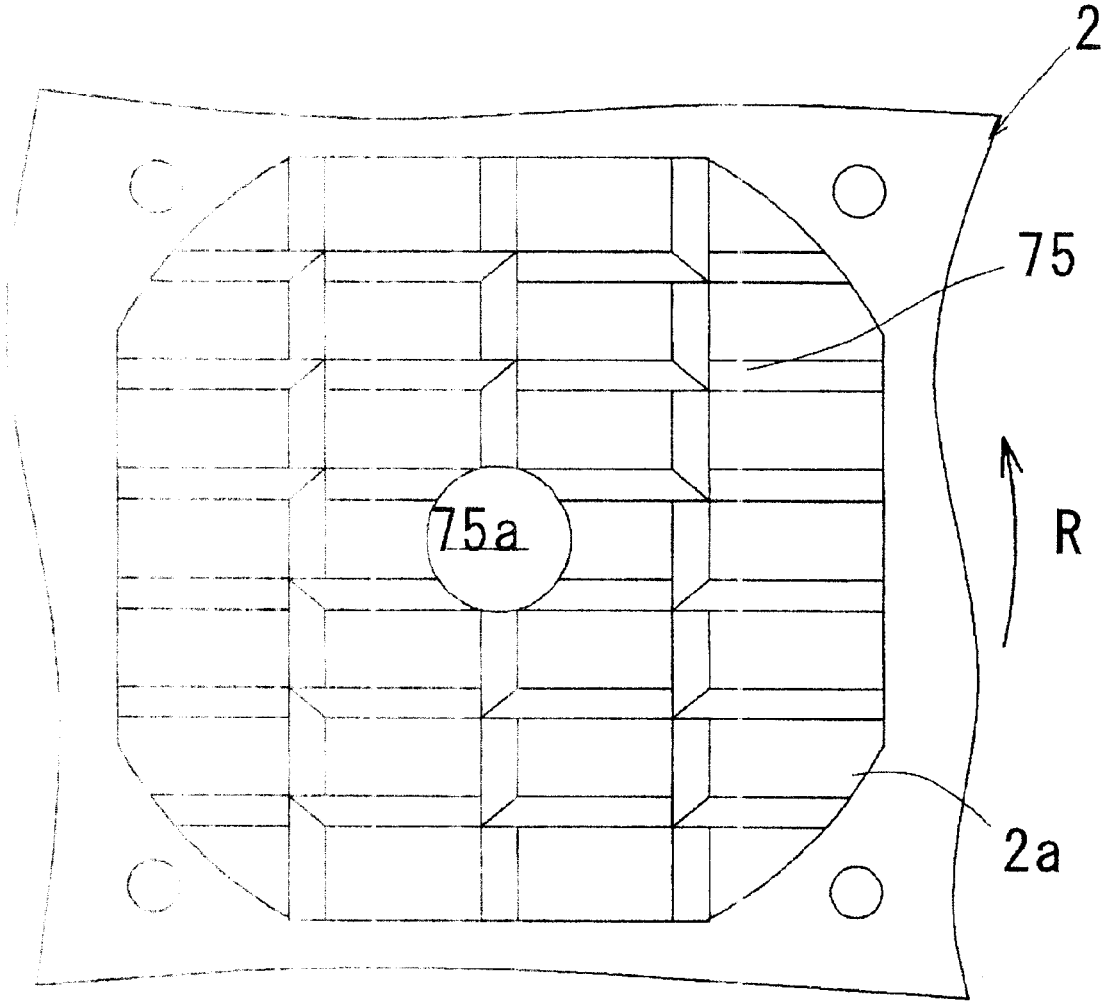
FIG. 8 is a plan view of a main portion in FIG. 7.

In the first and the second embodiments, the fan motor 10 is supported by the motor supporting portion 11 of the finger guard 5. In third embodiment, the structure for supporting the fan motor 10 is different from the first and the second embodiments. Namely, the fan motor 10 of the third embodiment is supported by the conventional housing 70 as shown in FIG. 7. The housing 70 constitutes a motor supporting portion 72 by ribs 83 that extend radially inside the cylindrical portion. The side wall of the case 2 is provided with an opening portion 2*a* having a finger guard 75 similarly to the first and the second embodiments as shown in FIG. 8. The finger guard 75 as shown in FIG. 8 has a structure of the rib that is similar to the first and the second embodiments except for the motor supporting portion (the circle in the middle in FIG. 8 is a portion only for sticking a rating plate).

(Concerning a Comparative Experiment)

Hereinafter, results of experiment that the inventor performed corresponding to the effects of the first through the third embodiments will be explained.

In the experiment, the electronic or electric devices according to the first through the third embodiments and the conventional electronic or electric device (a comparison example) were prepared, and quantity of airflow exhausted from the case and noise level were measured for each device. The conventional electronic or electric device is an electronic or electric device having the same structure as the third embodiment except for the cross section of the rib of the finger guard 75 that is a rectangle. Conditions for experiment such as a rotation speed of the fan motor and dimensions of the case and the opening portion 2*a* was the same.

Figure 9:
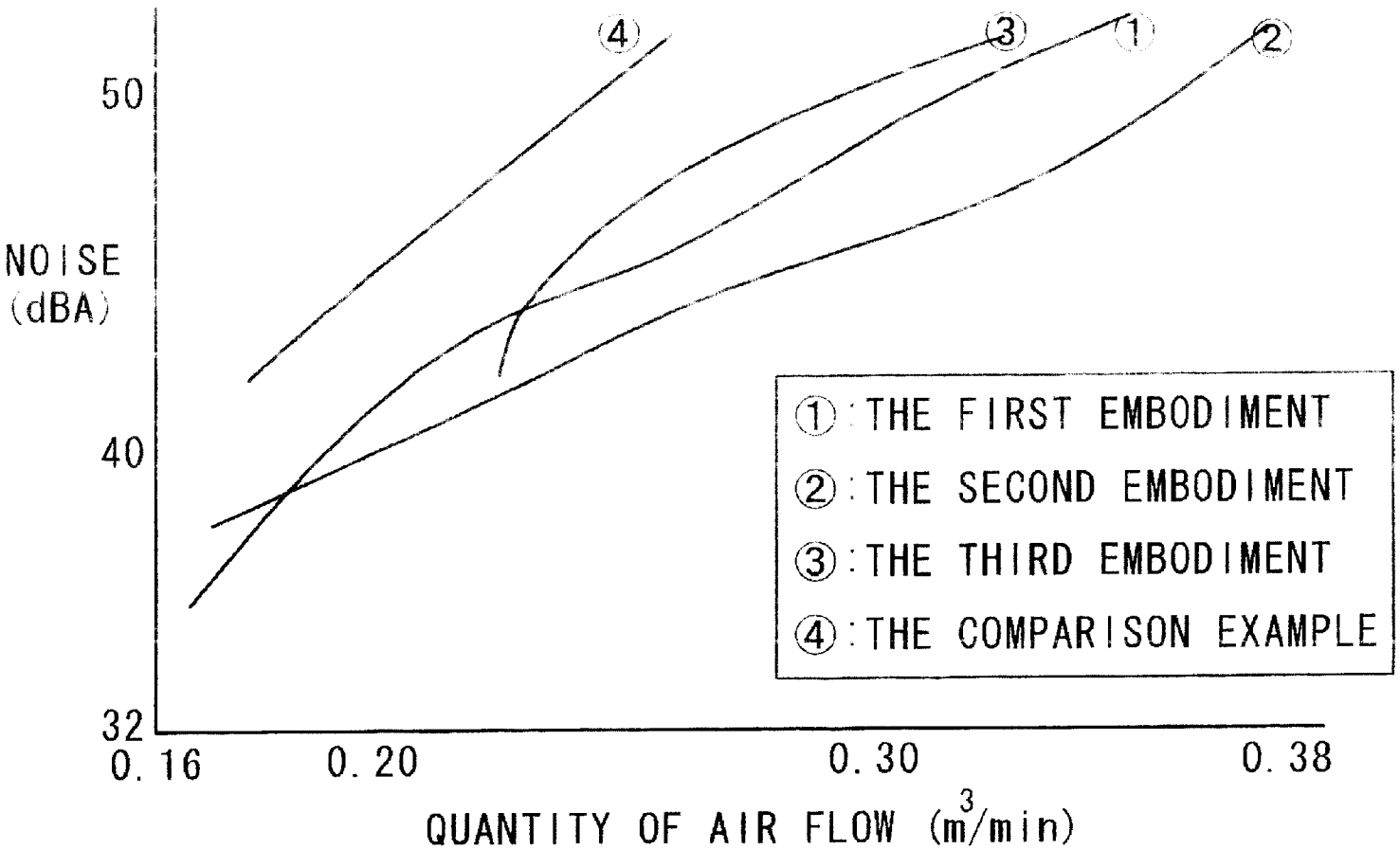
FIG. 9 is a graph showing measurement data of an experimental result in the first through the third embodiment.

Measured data of the quantity of airflow and the noise level corresponding to the above-mentioned four devices are shown in FIG. 9. It is clear that both the quantity of airflow and the noise level are better in any of the first through the third embodiments than the comparison example as shown in FIG. 9. The inventor had confidence about the effect the finger guards 5 and 75 from this result. Although the air exhausted from the fan motor 10 passes only the finger guard 5 in the first and the second embodiments, it passes two portions, i.e., the finger guard 75 and the rib 83 in the third embodiment. Therefore, the inventor thought that the reason why the third embodiment was inferior to the first and the second embodiments was related to the facts that the air resistance was increased by the rib 83 in the third embodiment, and that the air was involved in the gap between the rib 83 and the finger guard 75. Furthermore, the inventor thought that the reason why the second embodiment was superior to the first embodiment was related to the effect of the inclined surface 61*a* of the cylindrical member 61 in the second embodiment.

(Fourth Embodiment)

Figure 10:
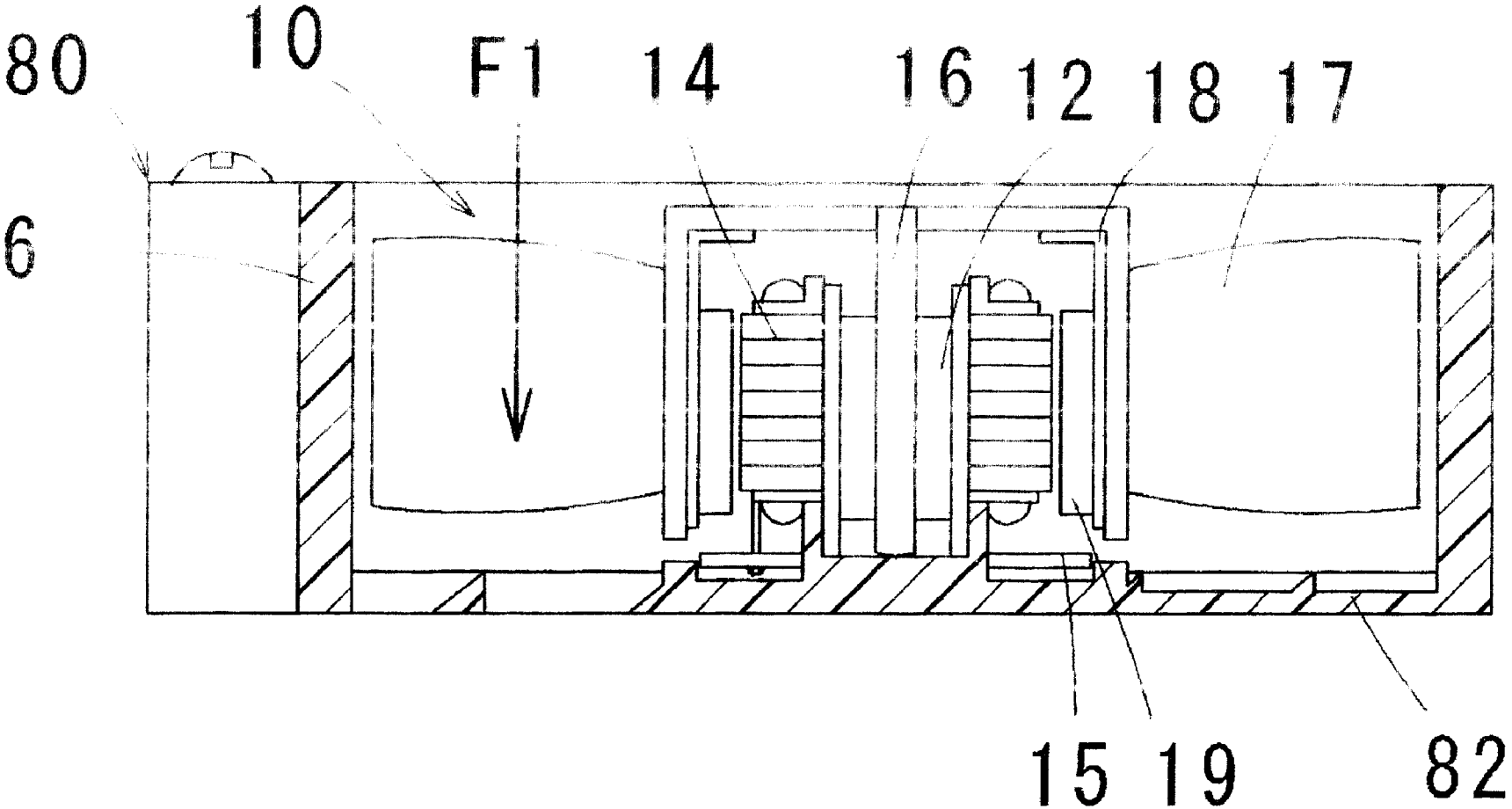
FIG. 10 is a cross section of a main portion showing an electronic or electric device according to a fourth embodiment of the present invention.

In the fourth embodiment, the fan motor 10 has a housing 80 and a finger guard 82 as shown in FIG. 10. The finger guard 82 has substantially the same structure as the sub panel 4 of the first embodiment. This fan motor 10 can be attached to various electronic or electric devices that require a finger guard attached to a fan itself. In addition, since the finger guard of the fan is the same as the first embodiment, characteristics of the quantity of airflow and the noise level are good.

(Fifth Embodiment)

Figure 11:
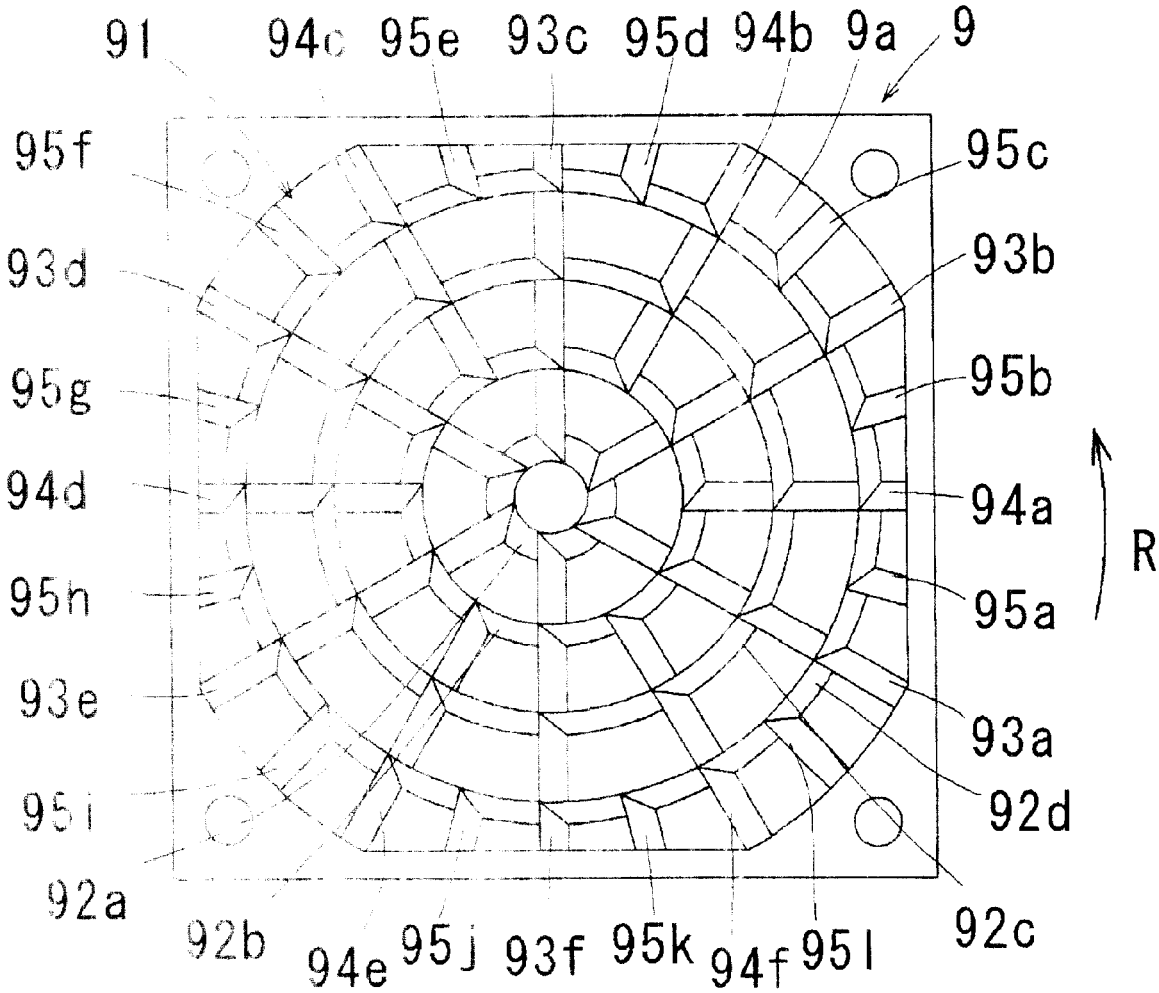
FIG. 11 is a plan view of a main portion showing an electronic or electric device according to a fifth embodiment of the present invention.

In the fifth embodiment, a finger guard that is deferent from the first embodiment will be explained. As shown in FIG. 11, this finger guard has a grid-like shape in which plural ribs cross each other, but the crossing way of the ribs that constitute the finger guard is different. Here, as the third embodiment, the form in which the fan motor is supported by another member separated from the finger guard of the case will be explained. FIG. 11 shows a part of the case and is a front view from the inside to the outside of the case.

Namely, as shown in FIG. 11, the case of this embodiment includes an opening portion 9*a* in the panel 9 that constitutes the case, and a finger guard 91 is provided to the opening portion 9*a* integrally. The finger guard 91 includes a first rib group 92 consisting of four ribs 92*a*–92*d* that are provided coaxially with a substantially constant pitch at the center of the opening portion 9*a* (corresponding to an annular rib), a second rib group 93 consisting of six ribs 93*a*–93*f* that are provided at a substantially constant pitch in the circumference direction at the position that connects the rib 92*a* and the inner rim of the opening portion 9*a* by a substantially straight line, a third rib group 94 consisting of six ribs 94*a*–94*f* that are provided at a substantially constant pitch in the circumference direction at the position that connects the rib 92*b* and inner rim of the opening portion 9*a* by a substantially straight line and that connects each middle point of the ribs of the second rib group 93, and a fourth rib group 95 consisting of twelve ribs 95*a*–95*l* that are provided at a substantially constant pitch in the circumference direction at the position that connects the rib 92*b* and inner rim of the opening portion 9*a* by a substantially straight line and that connects each middle point of the second rib group 93 and the third rib group 94. The first through fourth rib groups 92, 93, 94 and 95 cross and are connected to each other integrally at the inner rim of the opening portion 9*a* or between ribs. The second through fourth rib groups 93, 94 and 95 correspond to the radial rib groups.

The first through the fourth rib groups 92, 93, 94 and 95 have a cross section of a right triangle in the same way as the ribs in the above embodiments. Especially, the first rib group 92 has a surface enlarging its diameter from the inside to the outside of the opening portion 9*a* (corresponding to the above-mentioned inclined surface 5*c*), a height surface at the internal diameter side, and a bottom side surface outside the opening portion 9*a*.

In the second through the fourth rib groups 93, 94 and 95, the inclined surface is formed to face in the counter-clock direction around the center of the opening portion 9*a* in FIG. 11, the height surface is formed at the opposite side of the inclined surface, and the bottom side surface is formed outside the opening portion 9*a*.

In this embodiment too, adding to the intrinsic function of protection as a finger guard, at least one surface of the rib cross section of the finger guard 91 is the inclined surface that is substantially parallel to or along the cooling airflow, so that turbulence of air is prevented and high efficiency of cooling performance as well as low noise level is realized.

Furthermore, since the finger guard 91 has a rotation symmetric shape with respect to the center of the opening portion 9*a*, it has high stiffness, and good airflow property is obtained.

In addition, the small cells of opening defined by the ribs or by the ribs and the inner rim of the opening portion 9*a* are formed six between the rib 92*a* and the rib 92*b*, twelve between the rib 92*b* and the rib 92*c* as well as between the rib 92*c* and the rib 92*d*, and twenty four between the rib 92*d* and the inner rim of the opening portion 9*a*. Namely, each opening has the same width in the radial direction, and the number of the opening in the internal diameter side is smaller than that in the outer diameter side. Thus, the opening area becomes uniform over the entire area of the finger guard 91, so that an optimal arrangement is realized for both airflow property and a protection function.

Figure 12:
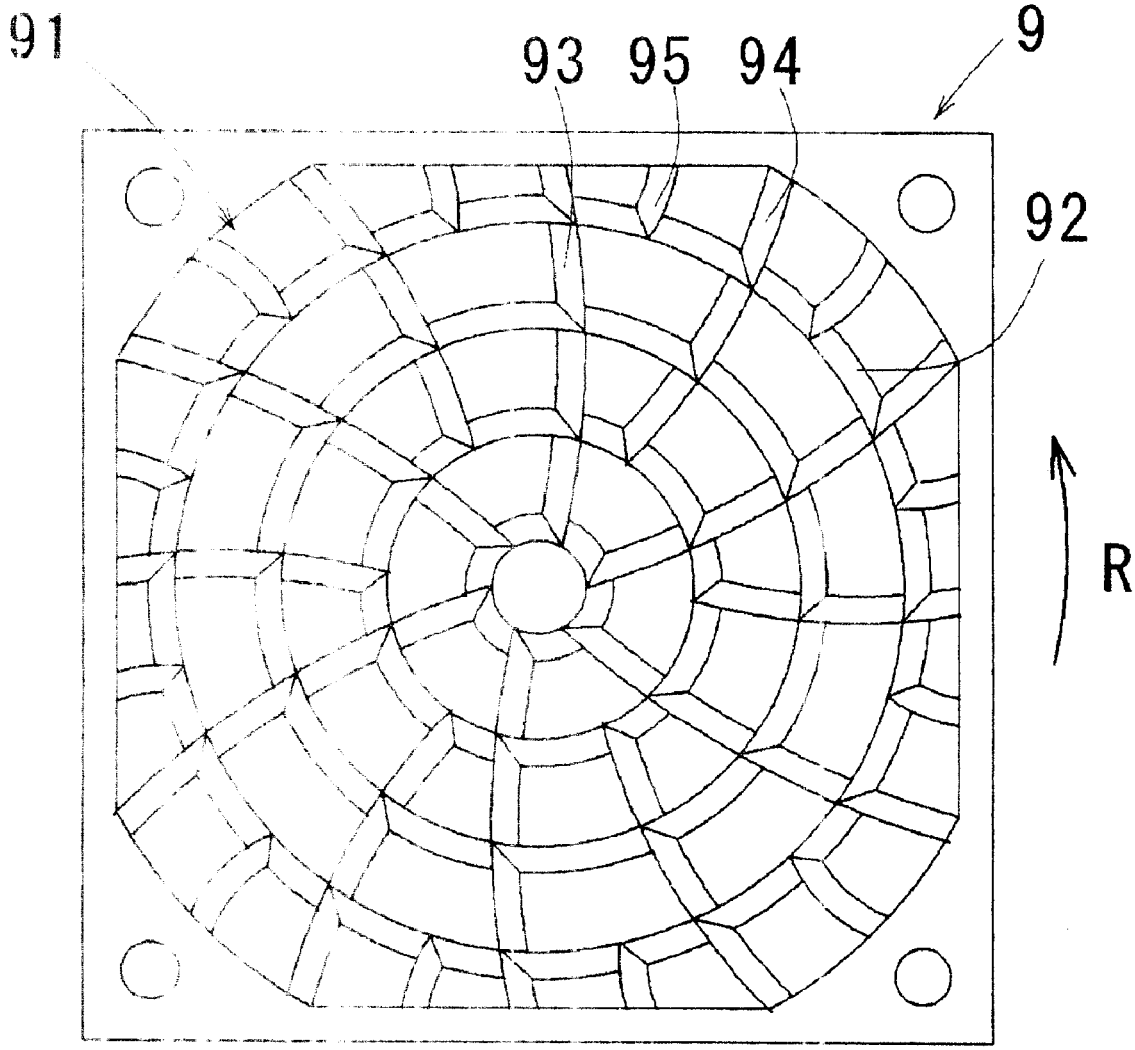
FIG. 12 is a plan view of a main portion of an electronic or electric device according to a variation of the fifth embodiment.
Figure 13A:
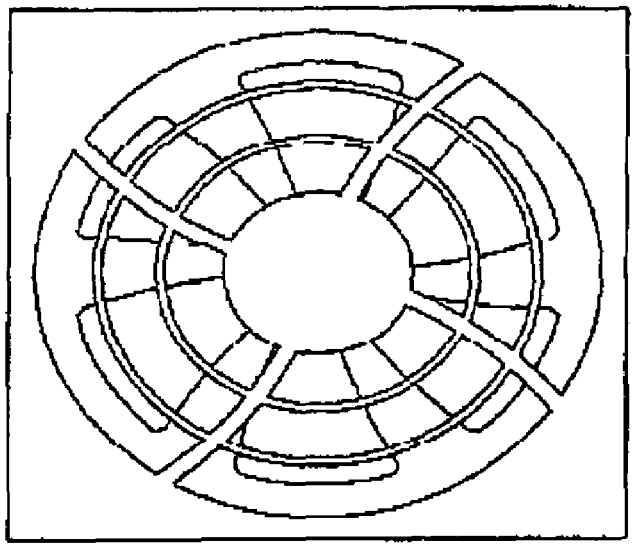
FIG. 13A Prior Art
FIGS. 13A and 13B are plan views showing conventional finger guards.
Figure 13B:
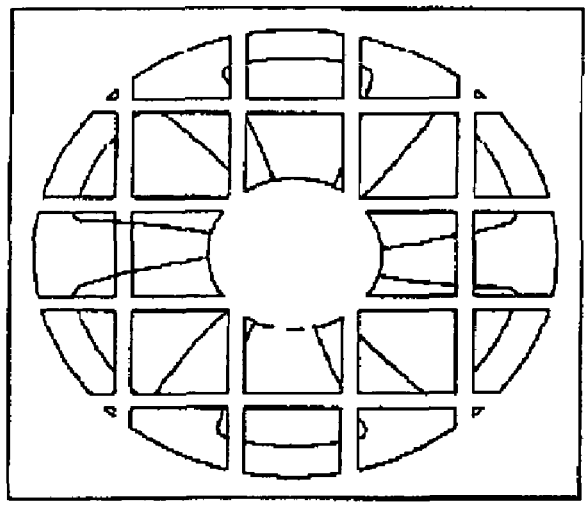
FIG. 13B Prior Art

Although the second through fourth rib groups 93, 94 and 95 have a linear shape in the fifth embodiment, they have a curved shape as shown in FIG. 12, so that air resistance can be further reduced. The fifth embodiment and this variation can be applied to any structure without limiting to the third embodiment as shown in FIG. 7. They can be also applied to the structure like the first embodiment as shown in FIG. 2 in which the motor supporting portion and the cylindrical portion are attached to the finger guard 91 integrally, or in the structure like the second embodiment as shown in FIG. 6 in which the cylindrical portion is provided as another separate member.

Although embodiments of the present invention are explained, the scope of the present invention is not limited to the embodiments, but various modifications can be performed within the scope of the present invention. For example, in the above embodiment, the finger guard portions 5 in FIG. 5, 75 in FIGS. 7 and 82 in FIG. 10 are corresponding to the case where air flows in the direction shown by the arrow F2 in FIG. 3. If the direction of the arrow F2 changes, the angle of the inclined surface 5*c* may be changed correspondingly. Furthermore, although the finger guard portion 5, 75 or 82 is provided to the sub panel or the case that constitutes the opening portion, it is possible to make the finger guard portion 5, 75 or 82 as a separate component. In addition, the shape of the impeller of the fan motor can be the other shape. Furthermore, the electronic or electric device can be applied to various usage such as a computer game machine or a printer, in which a fan motor is included together with a finger guard inside the case.

According to the case of the present invention, the fan motor can work without a malfunction even if it is arranged at the vicinity of the opening portion, since the protection portion prevents a finger or other matters from entering from the outside into the electric fan. In addition, quantity of airflow exhausted from the fan motor can be increased, and low noise level can be achieved.

Furthermore, in the electronic or electric device of the present invention, the protection portion can prevent a finger or other matters from entering from the outside into the electric fan. In addition, since airflow efficiency by the fan motor is good, a malfunction due to heat of electromechanical parts can hardly occur, and low noise level is obtained for high performance.

The invention claimed is:

1. A cooling fan motor comprising:

a cuplike rotor including a magnet and defining a rotational axis;

impeller blades fixed to the circumferential surface of the rotor to form an impeller unit generating an axial airflow to which a rotational airflow component is imparted, whereby said impeller unit delivers a spiral airflow defining an airflow vector inclined at a predetermined angle to the rotational axis;

a stator disposed facing the rotor magnet;

a frame constituting an outer frame of the fan motor, for retaining the stator; and a guard plate covering an outer surface of the frame, disposed on the airflow downstream side of the impeller unit, and either fixed to or formed integrally with the frame, the guard plate composed of ribs each of which in transverse section has at least one side inclined at substantially the same angle as said airflow vector, the ribs being arranged in a plurality of intersecting groups to form a meshwork in which each rib group intersects at least one other rib group in intersection lines inclined at substantially the same angle as said airflow vector.

2. The cooling fan motor according to claim 1, wherein each cell of the meshwork of intersecting rib groups in the guard plate is small enough so that at least a human finger cannot enter.

3. The cooling fan motor according to claim 1, wherein the guard plate rib groups extend linearly in two directions that are substantially perpendicular to each other.

4. The cooling fan motor according to claim 1, wherein the guard plate meshwork is formed of substantially circular rib groups arranged concentrically centered on the rotational axis of the fan motor, and of ribs groups substantially perpendicular to circular rib groups and extending radially from the rotational axis.

5. The cooling fan motor according to claim 1, wherein each of the guard plate ribs in transverse section is a right triangle whose inclined side is at substantially the same angle as said airflow vector.

6. The cooling fan motor according to claim 1, wherein each of the guard plate ribs in transverse section is a rectangle whose two longer sides substantially parallel said airflow vector.

7. A case for an electronic or electric device having a cooling fan motor that includes a cuplike rotor having a magnet and defining a rotational axis, impeller blade blades fixed to the circumferential surface of the rotor to form an impeller unit generating an axial airflow to which a rotational airflow component is imparted, whereby said impeller unit delivers a spiral airflow defining an airflow vector inclined at a predetermined angle to the rotational axis, a stator disposed facing the rotor magnet, and that includes a frame constituting an outer frame of the fan motor, for retaining the stator, the case comprising:

a guard plate covering the outer frame of the cooling fan motor, the guard plate disposed on the airflow downstream side of the impeller unit and either fixed to or formed integrally with the case, and composed of ribs each of which in transverse section has at least one side inclined at substantially the same angle as said airflow vector, the ribs being arranged in a plurality of intersecting groups to form a meshwork in which each rib group intersects at least one other rib group in intersection lines inclined at substantially the same angle as said airflow vector.

8. The cooling fan motor according to claim 7, wherein each cell of the meshwork of intersecting rib groups in the guard plate is small enough so that at least a human finger cannot enter.

9. The cooling fan motor according to claim 7, wherein the guard plate rib groups extend linearly in two directions that are substantially perpendicular to each other.

10. The cooling fan motor according to claim 7, wherein the guard plate meshwork is formed of substantially circular rib groups arranged concentrically centered on the rotational axis of the fan motor, and of ribs groups substantially perpendicular to circular rib groups and extending radially from the rotational axis.

11. The cooling fan motor according to claim 7, wherein each of the guard plate ribs in transverse section is a right triangle whose inclined side is at substantially the same angle as said airflow vector.

12. The cooling fan motor according to claim 7, wherein each of the guard plate ribs in transverse section is a rectangle whose two longer sides substantially parallel said airflow vector.

13. An electric device that includes a case and a cooling fan motor disposed at a predetermined position in the case, the cooling fan motor comprising a cuplike rotor including a magnet and defining a rotational axis, impeller blades fixed to the circumferential surface of the rotor to form an impeller unit generating an axial airflow to which a rotational airflow component is imparted, whereby said impeller unit delivers a spiral airflow defining an airflow vector inclined at a predetermined angle to the rotational axis, a stator disposed facing the rotor magnet, and that includes a frame constituting an outer frame of the fan motor, for retaining the stator, the case comprising:

a guard plate covering the outer frame of the cooling fan motor, the guard plate disposed on the airflow downstream side of the impeller unit and either fixed to or formed integrally with the case, the and composed of ribs each of which in transverse section has at least one side inclined at substantially the same angle as said airflow vector, the ribs being arranged in a plurality of intersecting groups to form a meshwork in which each rib group intersects at least one other rib group in intersection lines inclined at substantially the same angle as said airflow vector.

* * * * *